US009823045B2

(12) United States Patent
Chu et al.

(10) Patent No.: US 9,823,045 B2
(45) Date of Patent: Nov. 21, 2017

(54) ANGLE ADJUSTING STRUCTURE FOR AIMING SEAT OF CROSSBOW

(71) Applicant: MAN KUNG Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 14/989,002

(22) Filed: Jan. 6, 2016

(65) Prior Publication Data

US 2017/0191798 A1 Jul. 6, 2017

(51) Int. Cl.
*F41G 1/467* (2006.01)
*F41B 5/12* (2006.01)

(52) U.S. Cl.
CPC ..... *F41G 1/467* (2013.01); *F41B 5/12* (2013.01)

(58) Field of Classification Search
CPC . F41G 1/467; F41G 1/38; F41G 11/00; F41B 5/12
See application file for complete search history.

(56) References Cited

U.S. PATENT DOCUMENTS 2,452,592 A * 11/1948 Meyer ..... F41G 1/38 33/298
5,274,941 A * 1/1994 Moore ..... F41G 11/005 42/126
5,649,520 A * 7/1997 Bednar ..... F41B 5/12 124/25
8,240,075 B1 * 8/2012 Mullin ..... F41G 1/38 42/119
8,407,924 B2 * 4/2013 Lee ..... F41G 1/30 42/111
8,522,761 B1 * 9/2013 Chu ..... F41A 17/46 124/25
2008/0060629 A1 * 3/2008 Chang ..... F41B 5/123 124/25
2016/0377385 A1 * 12/2016 Culp ..... F41G 11/003 42/126

* cited by examiner

*Primary Examiner* — Melba Bumgarner
*Assistant Examiner* — Amir Klayman
(74) *Attorney, Agent, or Firm* — Alan D. Kamrath; Kamrath IP Lawfirm, P.A.

(57) ABSTRACT

A crossbow includes an angle adjusting structure for an aiming seat and contains a body, a bow arm, and an adjuster. The body includes a grip handle and intersects with the bow arm which is disposed on the body and includes a bowstring. The adjuster includes a trigger set which has a triggering support with a threaded hole. The adjuster also includes the aiming seat connecting with a rifle scope, and the aiming seat has an orifice rotatably connecting with the triggering support by using a coupling shaft. The aiming seat also has a front segment and a rear segment. Between the front segment and the triggering support is defined a resilient element for pushing the front segment upward, and the rear segment has a threaded rod extending downward therefrom. The threaded rod screws with a rotatable wheel between the aiming seat and the trigger set.

9 Claims, 8 Drawing Sheets

ANGLE ADJUSTING STRUCTURE FOR AIMING SEAT OF CROSSBOW

BACKGROUND OF THE INVENTION

Field of the Invention

The present invention relates to a crossbow and, more particularly, to an angle adjusting structure for an aiming seat of the crossbow.

Description of the Prior Art

A conventional crossbow is comprised of a body and a bow arm. The body includes a grip handle arranged on a rear end thereof, and the grip handle has a trigger set formed on a front end thereof. The trigger set has an aiming seat disposed thereon, and the aiming seat has a rifle scope mounted thereon. The bow arm is formed in an arc shape and is fixed on a front end of the body, and the bow arm intersects with the body in a cross shape. Between two ends of the bow arm is defined a bowstring. In operation, the bowstring is pulled backward and tightly to retain with the trigger set, and an arrow abuts against the body and the bowstring. Thereafter, a target object is aimed by the rifle scope, and the trigger set is triggered so that the bowstring removes from the trigger set. Hence, the arrow is pushed by the bowstring to shoot the target object.

However, an angle adjusting structure for the aiming seat of the conventional crossbow contains a rotatable wheel, and the rotatable wheel drives a threaded rod to move upward and downward, thus adjusting the angle of the aiming seat in a longitudinal direction. After the arrow shoots from the crossbow, vibration conducts from the bowstring to the body, and vibration and friction occur between the rotatable wheel and the threaded rod to change the angle of the aiming seat relative to the rifle scope, so the target object cannot be aimed by the crossbow precisely.

The present invention has arisen to mitigate and/or obviate the afore-described disadvantages.

SUMMARY OF THE INVENTION

The primary objective of the present invention is to provide an angle adjusting structure for an aiming seat of a crossbow which adjusts an angle of an aiming seat stably in a longitudinal direction. A screwing bolt screws with a threaded hole of a triggering support, so that the screwing bolt moves downward to force the aiming seat. After an arrow shoots from a bowstring, a vibration conducts to the body to avoid rotation and friction of a rotatable wheel and a threaded rod, thus preventing the angle of the aiming seat changing relative to a rifle scope.

Another objective of the present invention is to provide an angle adjusting structure for an aiming seat of a crossbow which is capable of aiming a target exactly and easily.

To obtain the above-mentioned objectives, an angle adjusting structure for an aiming seat of a crossbow provided by the present invention contains: a crossbow including a body, a bow arm, and an adjuster.

The body includes a grip handle formed on a rear end thereof, the bow arm is formed in an arc shape and is disposed on a front end of the body, and the body intersects with the bow arm. The bow arm includes a bowstring fixed on two ends of thereof.

The adjuster includes: a trigger set and an aiming seat.

The trigger set is arranged on a front side of the grip handle of the body and has a triggering support, and the triggering support has a threaded hole defined on a top thereof.

The aiming seat is mounted on an upper side of the triggering support and is configured to connect with a rifle scope, and the aiming seat has an orifice horizontally defined on a middle section thereof and rotatably connecting with the triggering support by using a coupling shaft. The aiming seat also has a front segment formed in front of the orifice, and the aiming seat has a rear segment arranged behind the orifice. Between the front segment and the triggering support is defined a resilient element configured to push the front segment of the aiming seat upward. The rear segment has a threaded rod extending downward from a bottom thereof, and the threaded rod screws with a rotatable wheel between the aiming seat and the trigger set, such that the rotatable wheel rotates to drive the threaded rod and the rear segment of the aiming seat to move upward, and such that the front segment of the aiming seat reversely moves upward and downward along the coupling shaft.

The aiming seat further has an aperture defined between the orifice and the threaded rod, such that a screwing bolt screws with the threaded hole of the triggering support via the aperture and forces the aiming seat.

DETAILED DESCRIPTION OF THE PREFERRED EMBODIMENTS

Figure 1:
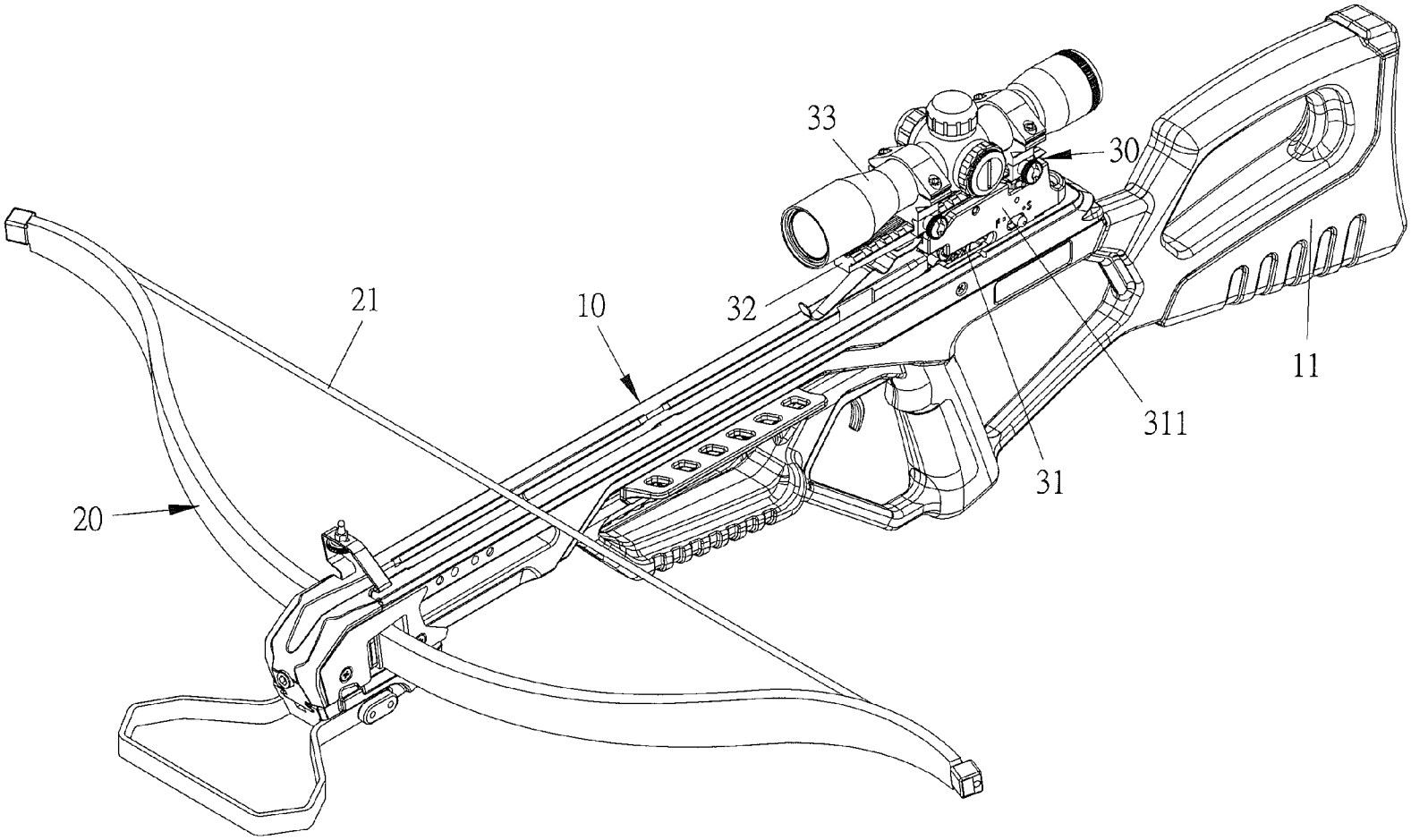
FIG. 1 is a perspective view showing the assembly of a crossbow in accordance with a preferred embodiment of the present invention.
Figure 2:
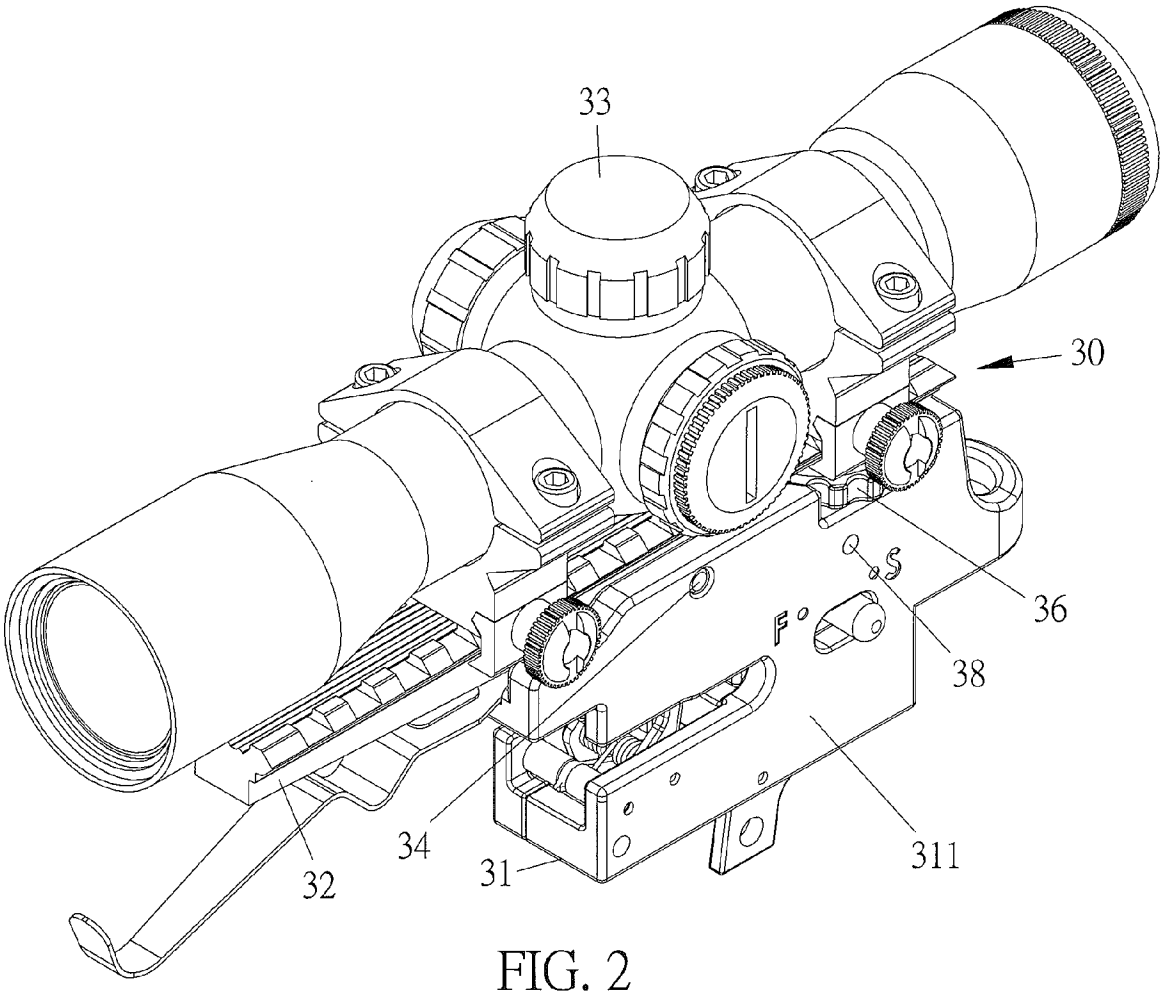
FIG. 2 is a perspective view showing the assembly of a part of the crossbow in accordance with the preferred embodiment of the present invention.
Figure 3:
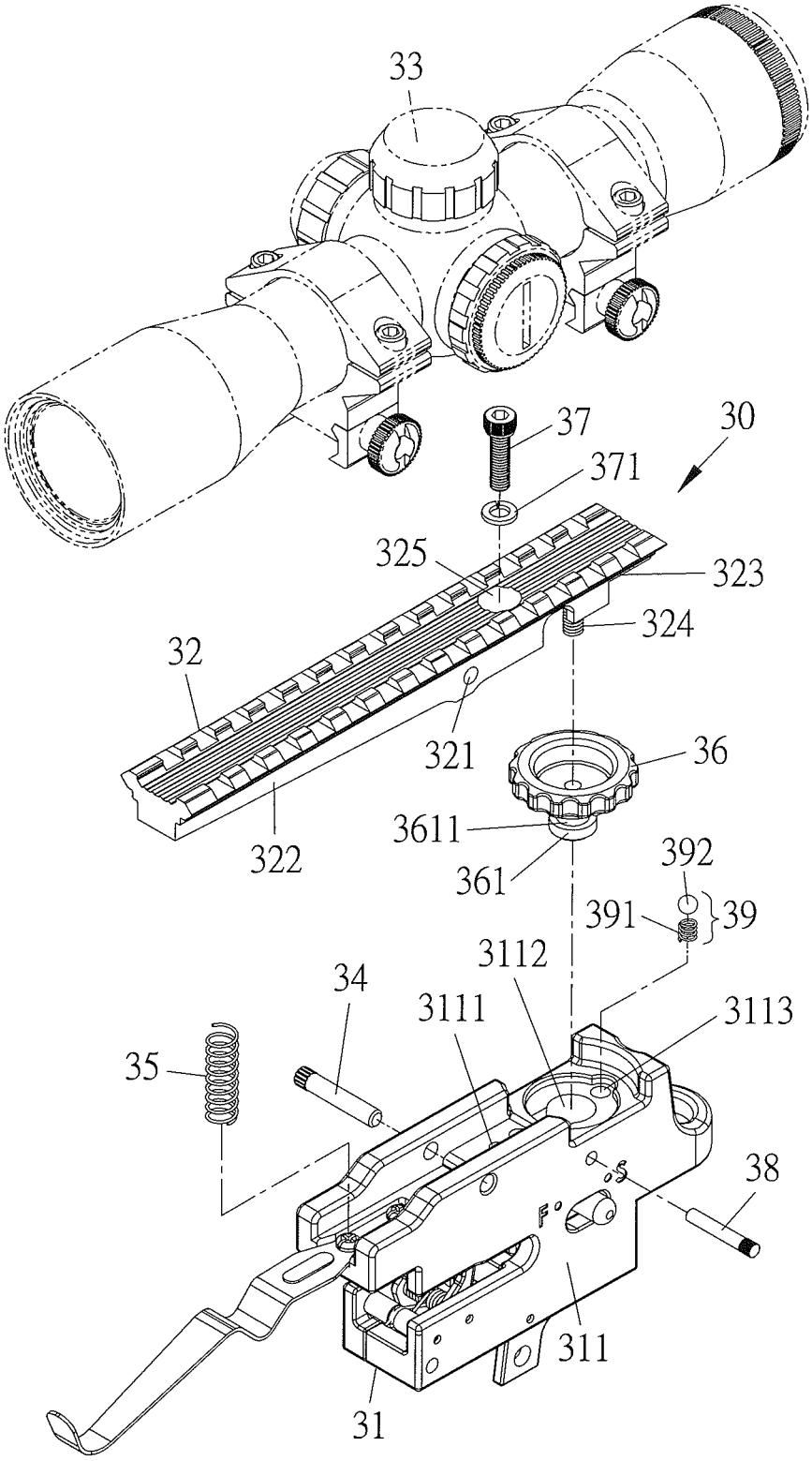
FIG. 3 is a perspective view showing the exploded components of an adjuster of the crossbow in accordance with the preferred embodiment of the present invention.
Figure 4:
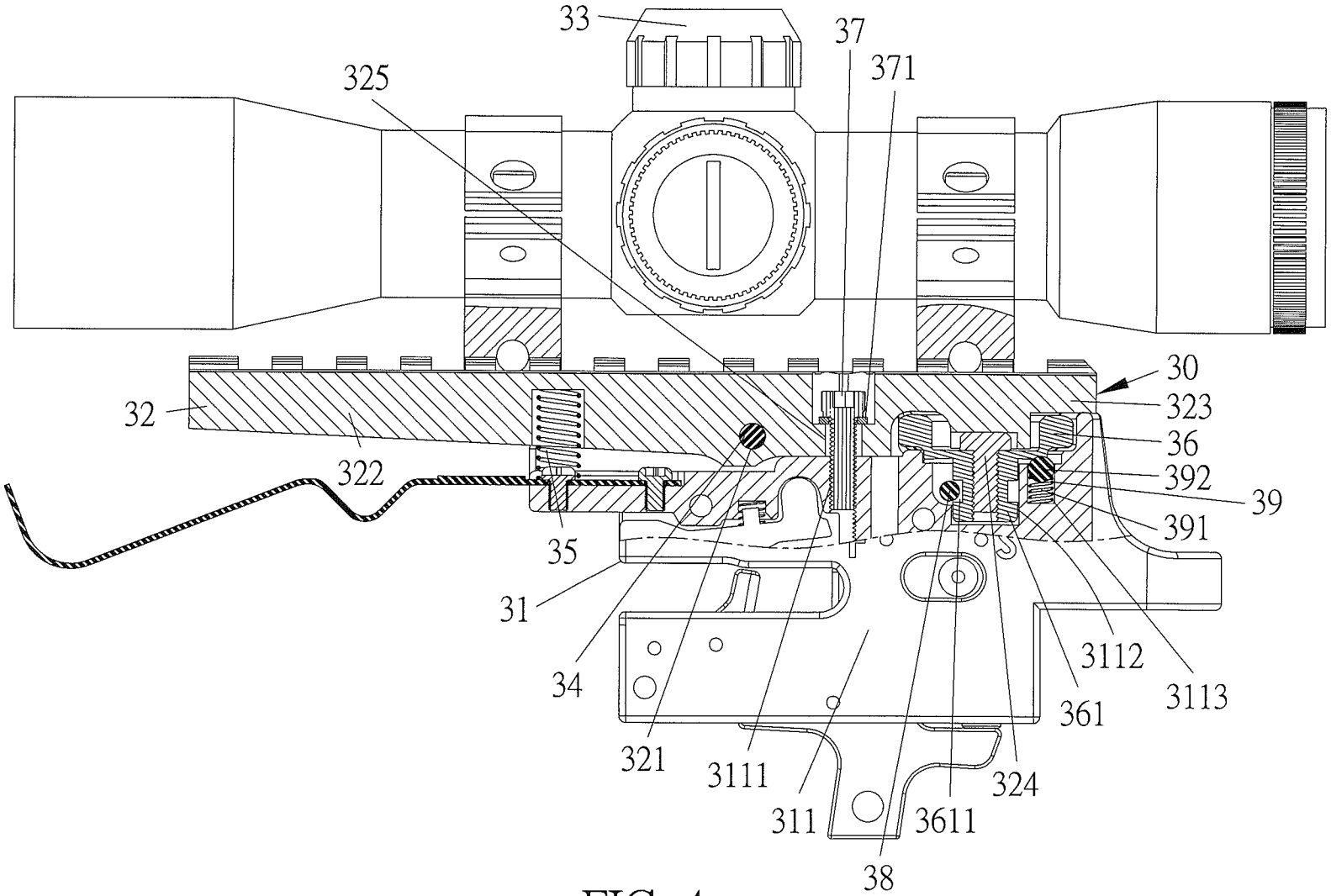
FIG. 4 is a cross sectional view showing the assembly of the adjuster of the crossbow in accordance with the preferred embodiment of the present invention.
Figure 5:
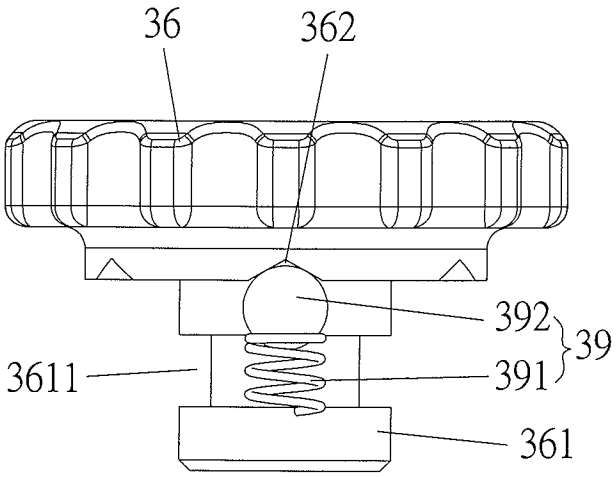
FIG. 5 is a perspective view showing the operation of a rotatable wheel of the crossbow in accordance with the preferred embodiment of the present invention.
Figure 6:
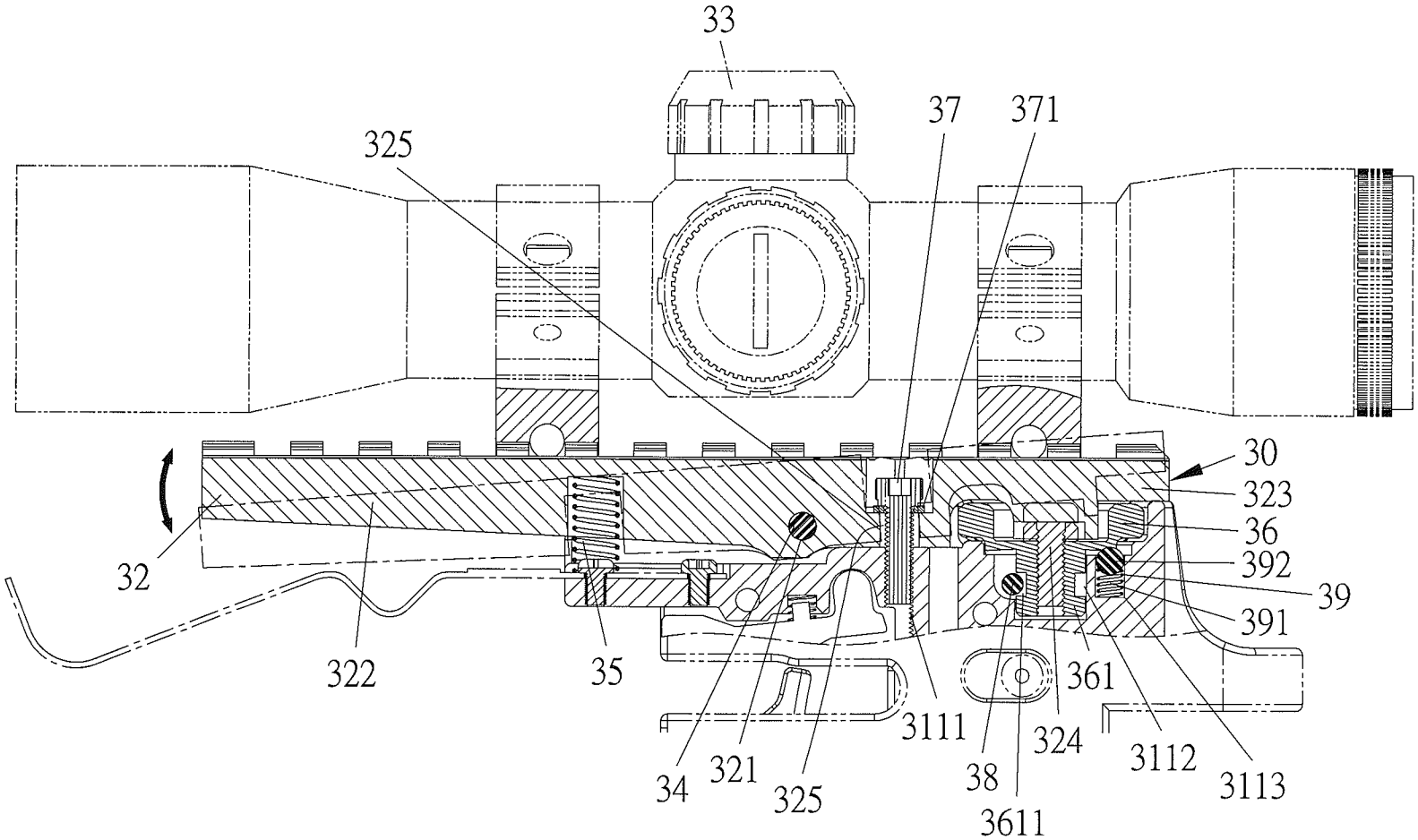
FIG. 6 is a cross sectional view showing the operation of the crossbow in accordance with the preferred embodiment of the present invention.

The present invention will be clearer from the following description when viewed together with the accompanying drawings, which show, for purpose of illustration only, the preferred embodiments in accordance with the present invention.

FIGS. 1-5 show an angle adjusting structure for an aiming seat of a crossbow according to a preferred embodiment of the present invention. The crossbow comprises: a body 10, a bow arm 20, and an adjuster 30. The body 10 includes a grip handle 11 formed on a rear end thereof. The bow arm 20 is formed in an arc shape and is disposed on a front end of the body 10, and the body 10 intersects with the bow arm 20. The bow arm 20 includes a bowstring 21 fixed on two ends of thereof. The adjuster 30 includes a trigger set 31 and an aiming seat 32. The trigger set 31 is arranged on a front side of the grip handle 11 and has a triggering support 311, and the triggering support 311 has a threaded hole 3111 defined on a top thereof. The aiming seat 32 is mounted on an upper side of the triggering support 311 and is configured to connect with a rifle scope 33. The aiming seat 32 has an orifice 321 horizontally defined on a middle section thereof and rotatably connecting with the triggering support 311 by using a coupling shaft 34. The aiming seat 32 also has a front segment 322 formed in front of the orifice 321 and has a rear segment 323 arranged behind the orifice 321. Between the front segment 322 and the triggering support 311 is defined a resilient element 35 configured to push the front segment 322 of the aiming seat 32 upward. In this embodiment, the resilient element 35 is a spring, and the rear segment 323 has a threaded rod 324 extending downward from a bottom thereof. The threaded rod 324 screws with a rotatable wheel 36 between the aiming seat 32 and the trigger set 31, such that the rotatable wheel 36 rotates to drive the threaded rod 324 and the rear segment 323 of the aiming seat 32 to move upward, and such that the front segment 322 of the aiming seat 32 reversely moves upward and downward along the coupling shaft 34. The aiming seat 32 further has a stepped aperture 325 longitudinally defined between the orifice 321 and the threaded rod 324, such that a screwing bolt 37 screws with the threaded hole 3111 of the triggering support 311 via the stepped aperture 325 and forces the aiming seat 32 downward. The screwing bolt 37 inserts through a washer 371.

The triggering support 311 has a groove 3112 formed on the top thereof, and the rotatable wheel 36 has a post 361 extending downward from a central position thereof and inserting into the groove 3112. The post 361 has a peripheral slot 3611 defined around a peripheral wall thereof, and the peripheral slot 3611 is configured to accommodate a limiting column 38 of the triggering support 311, such that the rotatable wheel 36 is fixed by the limiting column 38 to rotate in the groove 3112.

The triggering support 311 has a trench 3113 defined on the top thereof beside the groove 3112, and the rotatable wheel 36 has plural recesses 362 arranged around a bottom thereof. Between the rotatable wheel 36 and the triggering support 311 is defined an elastic positioning unit 39, and the elastic positioning unit 39 has a spring 391 and a steel ball 392 which are housed in the trench 3113 of the triggering support 311. The steel ball 392 is pushed by the spring 391 to move upward and selectively retain in one of the plural recesses 362, thus adjusting the rotatable wheel 36 in a multi-section adjusting manner.

When adjusting an angle of the aiming seat 32 in a longitudinal direction, the rifle scope 33 is removed from the aiming seat 32, and the screwing bolt 37 is unscrewed so that the aiming seat 32 is not forced by the screwing bolt 37. The rotatable wheel 36 rotates in a multi-section rotating manner to drive the threaded rod 324 and the aiming seat 32 to move upward and downward, such that the front segment 322 of the aiming seat 32 reversely moves upward and downward along the coupling shaft 34. The resilient element 35 moves between the front segment 322 of the aiming seat 32 and the triggering support 311, and the aiming seat 32 is adjustably moved to a required angle in the longitudinal direction. Thereafter, the screwing bolt 37 screws with the threaded hole 3111 of the triggering support 311, so that the screwing bolt 37 moves downward to force the aiming seat 32. The rifle scope 33 is connected with the aiming seat 32.

Figure 7:
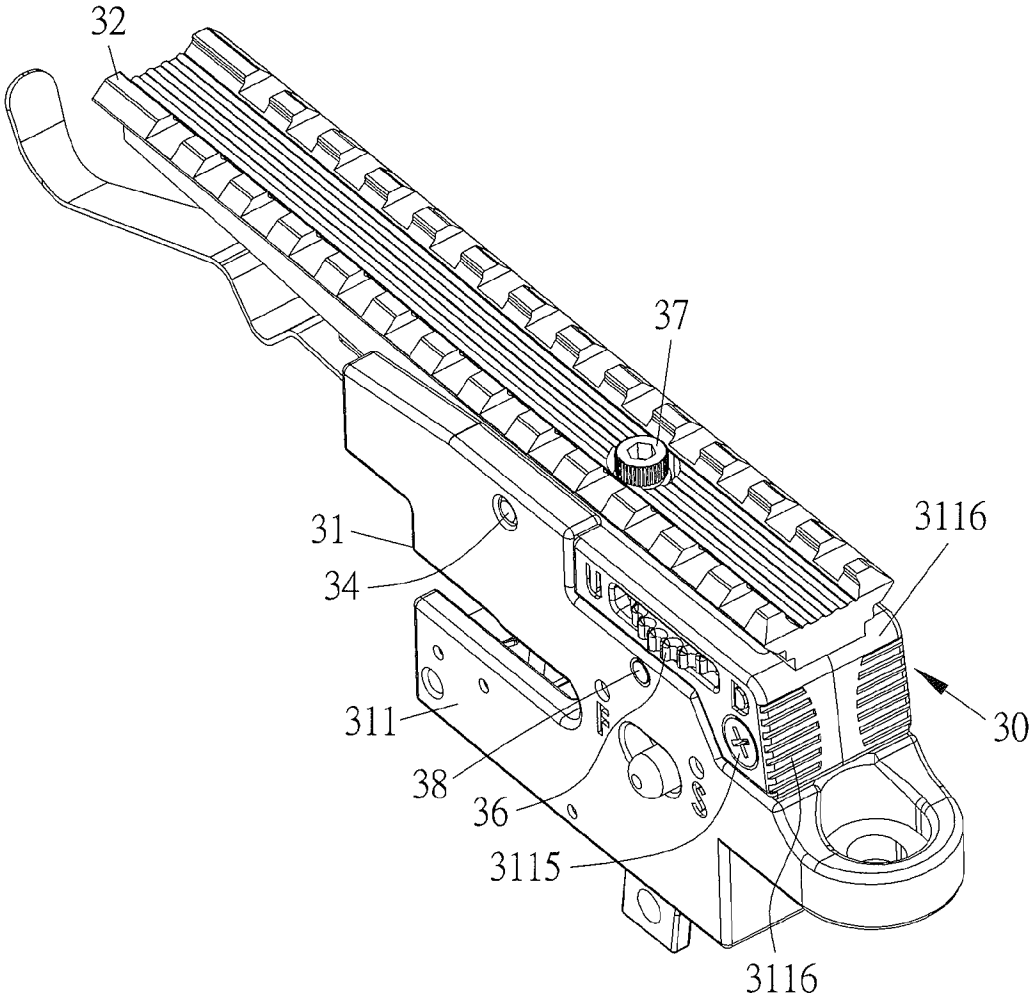
FIG. 7 is a perspective view showing the assembly of a trigger set of a crossbow in accordance with another preferred embodiment of the present invention.
Figure 8:
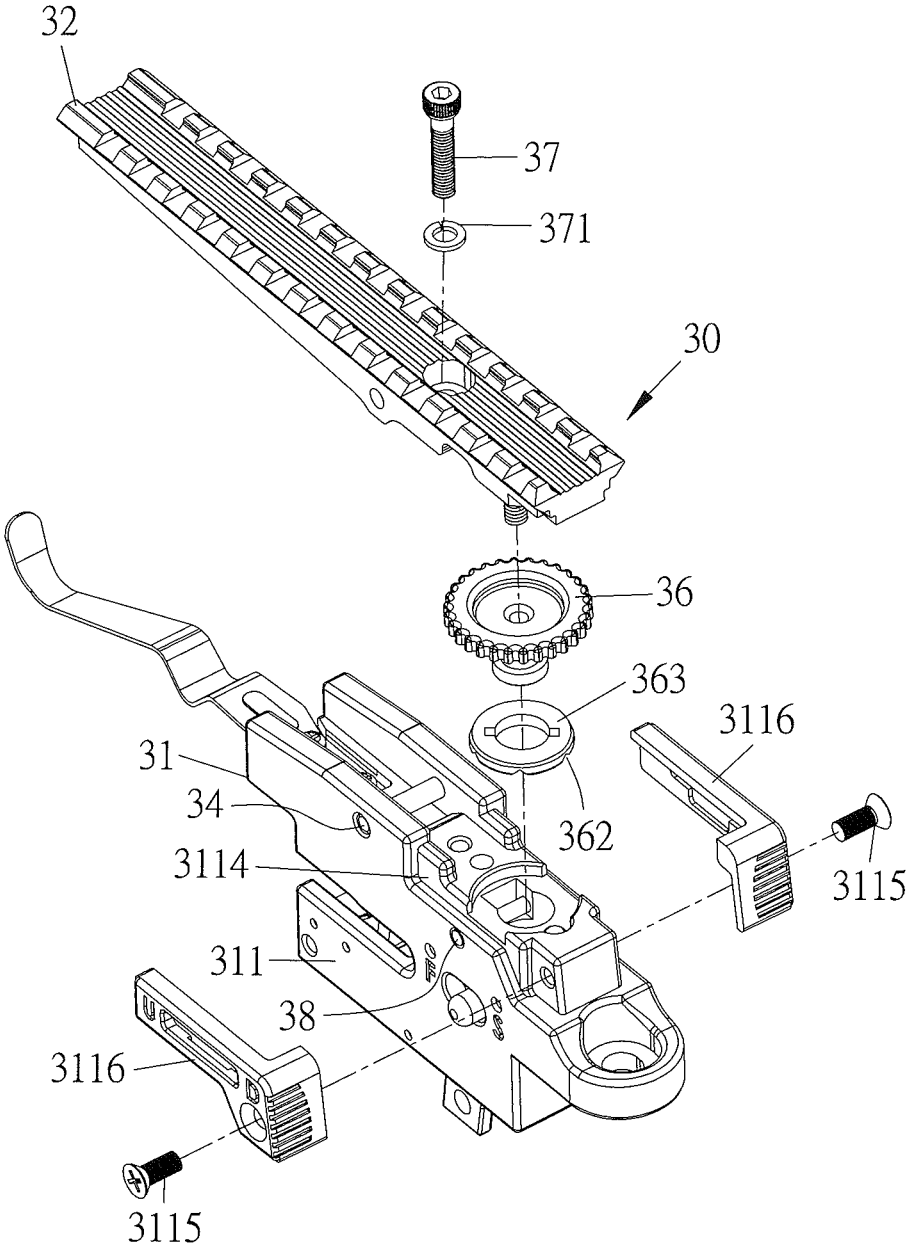
FIG. 8 is a perspective view showing the exploded components of the trigger set of the crossbow in accordance with said another preferred embodiment of the present invention.

As shown in FIGS. 7 and 8, the triggering support 311 of the trigger set 31 has a cutout 3114 which corresponds to at least one side of the rotatable wheel 36. In this embodiment, the cutout 3114 corresponds to two sides of the rotatable wheel 36. The cutout 3114 is coupled with a lid 3116 by way of a locking element 3115. In this embodiment, the locking element 3115 is a screw bolt. A profile of the lid 3116 corresponds to the cutout 3114. Hence, the triggering support 311 is covered by the lid 3116 to enhance aesthetics appearance of the crossbow and assemble the trigger set 31 easily.

As illustrated in FIG. 8, the rotatable wheel 36 of the adjuster 30 has a friction ring 363 fitted on a lower side thereof, the friction ring 363 and the rotatable wheel 36 are fixed together, and the plural recesses 362 are arranged on a bottom of the friction ring 363.

Accordingly, the angle adjusting structure of the present invention has advantages as follows:

The rotatable wheel 36 rotates to drive the threaded rod 324 and the rear segment 323 of the aiming seat 32 to move upward and downward, and the resilient element 35 acts between the front segment 322 of the aiming seat 32 and the triggering support 311. Hence the angle of the aiming seat 32 is adjusted stably in the longitudinal direction. The screwing bolt 37 screws with the threaded hole 3111 of the triggering support 311, so that the screwing bolt 37 moves downward to force the aiming seat 32. After an arrow shoots from the bowstring 21, a vibration conducts to the body 10 to avoid rotation and friction of the rotatable wheel 36 and the threaded rod 324, thus preventing the angle of the aiming seat 32 changing relative to the rifle scope 33. Preferably, the crossbow is capable of aiming a target exactly and easily.

While various embodiments in accordance with the present invention have been shown and described, it is clear to those skilled in the art that further embodiments may be made without departing from the scope of the present invention.

What is claimed is:

1. An angle adjusting structure comprising a crossbow comprising a body, a bow arm, and an adjuster;

with the body including a grip handle formed on a rear end thereof, with the bow arm formed in an arc shape and disposed on a front end of the body, with the body intersecting with the bow arm, and with the bow arm including a bowstring fixed on two ends of thereof;

with the adjuster including:

a trigger set arranged on a front side of the grip handle of the body and having a triggering support, with the triggering support having a threaded hole defined on a top thereof; and an aiming seat mounted on an upper side of the triggering support and configured to connect with a rifle scope, with the aiming seat having an orifice horizontally defined on a middle section thereof and rotatably connecting with the triggering support by a coupling shaft, with the aiming seat also having a front segment formed in front of the orifice, with the aiming seat having a rear segment arranged behind the orifice, wherein between the front segment and the triggering support is defined a resilient element configured to push the front segment of the aiming seat upward, wherein the rear segment has a threaded rod extending downward from a bottom thereof, wherein the threaded rod screws with a rotatable wheel between the aiming seat and the trigger set, wherein the rotatable wheel rotates to drive the threaded rod and the rear segment of the aiming seat to move upward, wherein the front segment of the aiming seat reversely moves upward and downward along the coupling shaft, wherein the aiming seat further has an aperture defined between the orifice and the threaded rod, and wherein a screwing bolt screws with the threaded hole of the triggering support via the aperture and forces the aiming seat wherein the rotatable wheel has plural recesses arranged around a bottom thereof, wherein between the rotatable wheel and the trigger support is defined an elastic positioning unit, wherein the elastic positioning unit has a spring and a steel ball, and wherein the steel ball is pushed by the spring to move upward and selectively retain in one of the plural recesses, thus adjusting the rotatable wheel in a multi-section adjusting manner.

2. The angle adjusting structure as claimed in claim 1, wherein the resilient element is a spring.

3. The angle adjusting structure as claimed in claim 1, wherein the aperture is a stepped aperture and is longitudinally defined between the orifice and the threaded rod.

4. The angle adjusting structure as claimed in claim 1, wherein the screwing bolt inserts through a washer.

5. The angle adjusting structure as claimed in claim 1, wherein the triggering support has a groove formed on the top thereof, and wherein the rotatable wheel has a post extending downward from a central position thereof and inserting into the groove.

6. The angle adjusting structure as claimed in claim 5, wherein the post has a peripheral slot defined around a peripheral wall thereof, wherein the peripheral slot is configured to accommodate a limiting column of the triggering support, and wherein the rotatable wheel is fixed by the limiting column to rotate in the groove.

7. The angle adjusting structure as claimed in claim 1, wherein the triggering support has a trench defined on the top thereof to house the spring and the steel ball.

8. The angle adjusting structure as claimed in claim 1, wherein the rotatable wheel of the adjuster has a friction ring fitted on a lower side thereof, wherein the friction ring and the rotatable wheel are fixed together, and wherein the plural recesses are arranged on a bottom of the friction ring.

9. The angle adjusting structure as claimed in claim 1, wherein the triggering support of the trigger set has a cutout which corresponds to at least one side of the rotatable wheel, wherein the cutout is coupled with a lid by a locking element, and wherein a profile of the lid corresponds to the cutout.

* * * * *